US007040494B2

(12) United States Patent
Harper

(10) Patent No.: US 7,040,494 B2
(45) Date of Patent: May 9, 2006

(54) STOCK SHELVING SYSTEM

(75) Inventor: John Michael Harper, Kelowna (CA)

(73) Assignee: Custom Shelving Solutions Ltd., Kelowna (CA)

( * ) Notice: Subject to any disclaimer, the term of this patent is extended or adjusted under 35 U.S.C. 154(b) by 209 days.

(21) Appl. No.: 10/691,489

(22) Filed: Oct. 24, 2003

(65) Prior Publication Data

US 2004/0182805 A1 Sep. 23, 2004

Related U.S. Application Data

(63) Continuation-in-part of application No. 10/658,284, filed on Sep. 10, 2003.

(60) Provisional application No. 60/454,600, filed on Mar. 17, 2003.

(51) Int. Cl.
*A47F 5/08* (2006.01)
*A47F 5/00* (2006.01)

(52) U.S. Cl. ..... 211/90.02; 211/135; 211/153

(58) Field of Classification Search ..... 211/90.02, 211/153, 135, 134, 186, 90.01, 88.02; 108/27, 108/90

See application file for complete search history.

(56) References Cited

U.S. PATENT DOCUMENTS

| | | | | | |
|---|---|---|---|---|---|
| 177,911 | A * | 5/1876 | Wolf et al. | 108/69 |
| 3,998,069 | A * | 12/1976 | Kronenberger et al. | 62/288 |
| 4,679,818 | A * | 7/1987 | Kakavas | 280/33.992 |
| 4,713,949 | A * | 12/1987 | Wilcox | 68/235 R |
| 4,960,308 | A * | 10/1990 | Donaghy | 312/404 |
| 5,020,758 | A * | 6/1991 | Rawlyk | 248/250 |
| 5,228,581 | A * | 7/1993 | Palladino et al. | 211/153 |
| 5,353,939 | A * | 10/1994 | Beeler et al. | 211/59.3 |
| 5,538,147 | A * | 7/1996 | Fucci | 211/153 |
| 5,573,322 | A * | 11/1996 | Wrobel | 312/400 |
| 5,720,230 | A * | 2/1998 | Mansfield | 108/108 |
| 6,021,908 | A * | 2/2000 | Mathews | 211/90.02 |
| 6,042,207 | A * | 3/2000 | Crosby et al. | 312/351 |
| 6,364,136 | B1 * | 4/2002 | Weshler et al. | 211/90.02 |
| 6,375,015 | B1 * | 4/2002 | Wingate | 211/59.3 |
| 6,497,185 | B1 * | 12/2002 | Barrett et al. | 108/108 |
| 6,725,785 | B1 * | 4/2004 | Wang | 108/90 |
| 6,907,829 | B1 * | 6/2005 | Bambach et al. | 108/65 |

* cited by examiner

*Primary Examiner*—Jennifer E. Novosad
(74) *Attorney, Agent, or Firm*—Anthony C. Edwards

(57) ABSTRACT

A shelf overlay for mounting to a shelving system having at least one horizontal shelf mounted at opposite ends of the shelf to a pair of parallel and vertical spaced apart shelving standards. At least one such shelf overlay is mountable onto corresponding shelves. Each shelf overlay includes a rigid planar portion, a lip, and mounting means. The rigid planar portion is bounded by a front edge, an oppositely disposed rear edge, and opposite side edges. The lip is orthogonal to the planar portion and is mounted along the front edge so as to extend from each of the opposite side edges. The lip extends downwardly from the planar portion so as to substantially cover a front edge surface of a corresponding shelf when the shelf overlay is mounted onto the corresponding shelf. The lip may also extend upwardly from the planar portion. The lip may be planar or may be convexly curved in a horizontal plane.

11 Claims, 12 Drawing Sheets

2
6
8
20

6
8

8
6

8
6

8
6

8
6

8
2

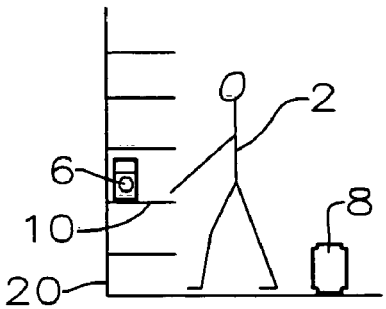
Fig 7a
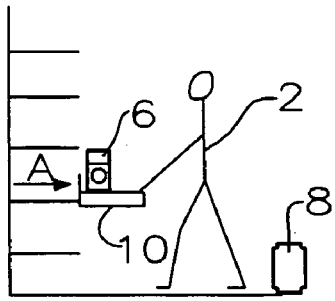
Fig 7b
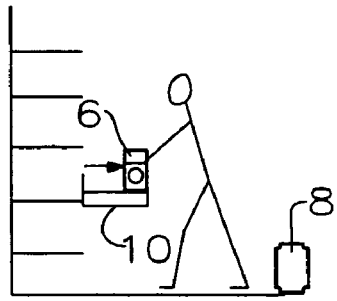
Fig 7c
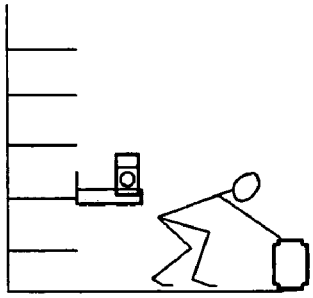
Fig 7d
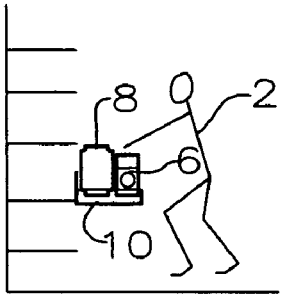
Fig 7e
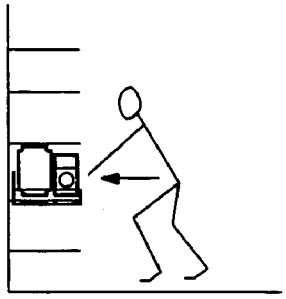
Fig 7f
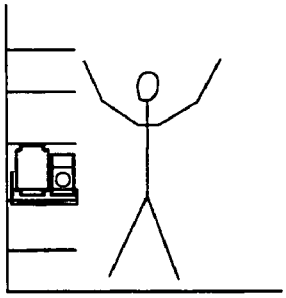
Fig 7g
Fig 7

STOCK SHELVING SYSTEM

CROSS REFERENCE TO RELATED APPLICATION

This application is a Continuation-in-Part of U.S. patent application Ser. No. 10/658,284 filed Sep. 10, 2003 which claims priority from U.S. Provisional Patent Application No. 60/454,600 filed Mar. 17, 2003 entitled Stock Shelving System.

FIELD OF THE INVENTION

This invention relates to the field of pull-out shelving system for retail stores having high stock turnover such as retail grocery stores and the like, and in particular to a retro-fit system including a shelf overlay.

BACKGROUND OF THE INVENTION

In retail stores, 75% of the product is sold from 25% of the store. For example, a 25,000 square foot store with 12 aisles will have 4 of those aisles producing 75% of the store total sales. These sections are known as high and low traffic areas. Because 75% of the stores' sales originate from the high traffic area, 75% of the stocking costs are spent replenishing 25% of the store. With any business, inventory control is a key ingredient in deriving profits from operations. Pharmacies and other retailers of consumable products must ensure that their inventory is properly rotated (old inventory sold before new inventory) each time the shelf is stocked.

Conventional shelving units seen in the retail market typically comprise a flat board used as a shelf, brackets with tangs, and vertical supports or standards. The bracket tangs are inserted into slots in the vertical supports, and the flat board typically rests on these brackets. The prior art also contains designs and systems for sliding, extensible or pull-out shelves, and in this regard applicant is aware of the following U.S. Pat. Nos. 5,720,230; 6,021,908; 6,497185; 6,364,136; and 6,375,015.

The prior art described or referenced above represent stand-alone systems for the attachment of tangs to standards. It is therefore one object of the present invention to provide for the interchangeability of shelves and tangs with standards regardless of the spacing of the standards or the location of the apertures or slots in the standards.

SUMMARY OF THE INVENTION

The shelving system of the present invention provides shopkeepers with the ability to pull out their shelves, allowing reduced labour time and expense, easier inventory counts, and better quality control. These combined advantages reduce operating costs.

The pull-out stock shelving system of the present invention makes the re-stocking process more efficient. This is accomplished by removing the step of having to take the old product off the conventional fixed shelf and placing it on the floor, only to have to return it back onto the shelf once the new product is loaded onto the rear of the shelf. This also potentially reduces the amount of bending a worker has to perform.

By eliminating the stage of having to put the old product on the floor and then putting it back after unpacking and placing the new product on the shelf, the shelving system of the present invention speeds up this otherwise laborious process.

The shelving system of the present invention mounts to existing shelving standards, saving the cost of a full replacement system. The shelving system reduces the time required to re-stock as well as eases inventory and sales tracking.

The present invention is both a novel hardware system for retrofitting pull-out shelves onto existing standards, and for improved modular shelf construction, and is also a novel method. The method of the present invention is for installing and operating selectively extendable and retractable pullout shelves constructed according to the present invention. Each of the shelves may include:

(a) a generally horizontal shelf which may be modularly constructed to adjust its depth and to provide curved or flat front edges; and, (b) mounted to the generally horizontal shelf, at and beneath longitudinally opposite ends of the shelf, so as to be disposed substantially entirely beneath the opposed ends of the shelf, an opposed pair of drawer runners or slides (hereinafter slides) extending across the ends of the shelf for selective translation of the shelf from a retracted position adjacent a shelving standard, to which is mounted the pair of drawer slides on mounting brackets, to an extended position extended cantilevered from the shelving standard on the pair of drawer slides;

(c) a generally vertically extending rear flange extending generally upwardly from the shelf along a first or rearmost edge thereof adjacent the shelving standard; and (d) one or more hooked-tang keys and one or more spacers mounted to the mounting bracket so as to build out the base ends of the brackets to align the tangs on the keys with existed mounting slots in the columns of the standards. The keys and spacers may be releasably mountable by, for example, rigid bolts journalled through the brackets so as to allow for adjustment of the width of the column spacing on the standards.

The method includes the steps of:

(a) laterally translating in a first direction the shelf from the retracted position to the extended position, (b) laterally translating old product on the shelf in the first direction so as to abut and face the old product against a second or forward edge of the shelf opposite to the first or rearmost edge, (c) stock new product on the shelf behind the old product on the shelf so as to position the new product adjacent the old product between the old product and the rearmost edge of the shelf, (d) laterally translate the shelf in a second direction opposite to the first direction from the extended position to the retracted position.

The shelf may further comprise a second flange mountable to the forward edge of the shelf. The second flange may extend vertically above the upper shelf surface to thereby form a lip against which the old product may be faced. In a further aspect the second flange may be adapted to present information outwardly of the forward edge of the shelf and in yet a further aspect the second flange may be selectively positionable between a vertically raised position, so as to form the lip, and a lowered position so as to be flush with an upper surface of the shelf.

Further advantageously the pullout shelves of the present invention are mountable to the shelving standard in closely spaced array, side-by-side between adjacent standards.

In summary the present invention according to one aspect is a shelving system for mounting to at least one pair of parallel, substantially vertical, laterally spaced apart shelving standards, where the standards are laterally spaced apart a first distance. The system includes:

a) at least one pair of keys adapted for releasably interlocking mating with the pair of standards, at least one key per each standard;

b) at least one pair of rigid bracket arms mounted or mountable to the keys, each bracket arm mounted or mountable to a corresponding key, c) manually extendable slides, mounted or mountable to each bracket arm, translatable between a retracted position and an extended position cantilevered from each bracket arm, d) a rigid substantially planar shelf mounted or mountable onto, at opposite ends thereof, and so as to extend between the slides when mounted to each pair of bracket arms, wherein the shelf has a first length measured from and between each end, e) at least one spacer mounted or mountable, by spacer mounting means, between each bracket arm and the corresponding key so as to adjust the distance between one pair of keys, when mounted to the bracket arms, to correspond to the first distance when the first length is less than the first distance.

Each bracket arm may be planar and the corresponding key may be planar or may be dog-legged in plan view so as to align a distal end of the corresponding key, distal to an end of the corresponding key mountable to the each bracket arm, with the each bracket arm when the corresponding key is mounted to the each bracket arm. Each spacer may also be planar.

The shelf may include modularly interlocking shelf members which are releasably mountable to one another. Thus a shelf depth perpendicular to the first length may be adjusted by removing or installing the shelf members from or onto the shelf respectively. The shelf members may also include a front member mountable at a distal end of the each pair of rigid bracket arms, distal to opposite ends of the each pair of rigid bracket arms mountable to the corresponding keys. The front member may include electronic merchandising means mounted within the front member.

Advantageously the keys include protruding hooked tangs for hooked mating with corresponding slots in the standards. A selectively actuable actuator may be provided which is mountable to each key for selectively engaging a corresponding standard when the each key is mounted thereto. The actuator tightens and thereby increases the rigidity of the hooked mating of the tangs into the slots in the standards. In one embodiment the actuator includes a threaded member rotatably mounted to each key and a bored elongate member threadably non-rotatably mounted onto one end of the threaded member, where the elongate member is mounted to each key for sliding translation relative thereto. The threaded member may be a bolt and the elongate member may be a threaded cylinder having at least one elongate channel along its length sliding mating with a corresponding edge of each key. The bolt and the cylinder may be mounted into a correspondingly sized cut-out in each key.

In one embodiment, the slides and the corresponding shelf mounted thereon are releasably lockable in a fully or partially extended position by releasable locking means on the bracket arms engaging the slides. The locking means may be a pin engaging one aperture in the slides.

In a further aspect, the method according to the present invention of facing stock on a shelving system includes the steps of:

a) providing at least one pair of parallel, substantially vertical, laterally spaced apart shelving standards laterally spaced apart a first distance;

b) providing at least one pair of keys releasably mated with the at least one pair of standards, c) providing at least one pair of rigid bracket arms mounted to the at least one pair of keys, each bracket arm of the at least one pair of rigid bracket arms mounted to a corresponding key of the at least one pair of keys, d) providing manually extendable slides, mounted to the each bracket arm, translatable between a retracted position and an extended position cantilevered from the each bracket arm, e) providing a rigid substantially planar shelf mounted onto, at opposite ends thereof, and so as to extend between the slides when mounted to each pair of rigid bracket arms of the at least one pair of rigid bracket arms, wherein the shelf has a first length measured from each end of the opposite ends, f) providing at least one spacer mountable, by spacer mounting means, between the each bracket arm and the corresponding key, and g) adjusting the distance between the at least one pair of keys, when mounted to the at least one pair of rigid bracket arms, to correspond to the first distance when the first length is less than the first distance.

The method may also include the steps of:

(a) laterally translating in a first direction the shelf from the retracted position to the extended position, (b) laterally translating old product on the shelf in the first direction so as to abut and face the old product against a second or forward edge of the shelf opposite to the first or rearmost edge, (c) stock new product on the shelf behind the old product on the shelf so as to position the new product adjacent the old product between the old product and the rearmost edge of the shelf, (d) laterally translate the shelf in a second direction opposite to the first direction from the extended position to the retracted position.

The method may also include the step of providing a flange mounted to a forward edge of the shelf, where the flange extends vertically upwards, against which the stock may be faced.

In summary, the shelf overlay, according to one aspect of the present invention, is for mounting to a shelving system having at least one horizontal shelf mounted at opposite ends of the shelf to a pair of parallel and vertical spaced apart shelving standards. At least one such shelf overlay is mountable onto corresponding shelves. Each shelf overlay includes a rigid planar portion, a lip, and mounting means. The rigid planar portion is bounded by a front edge, an oppositely disposed rear edge, and opposite side edges. The lip is orthogonal to the planar portion and is mounted along the front edge so as to extend from each of the opposite side edges. The lip extends downwardly from the planar portion so as to substantially cover a front edge surface of a corresponding shelf when the shelf overlay is mounted onto the corresponding shelf. The lip may also extend upwardly from the planar portion. The lip may be planar or may be convexly curved in a horizontal plane.

The mounting means is for mounting the planar portion onto an upper surface of the corresponding shelf. The mounting means may include an adhesive and/or mechanical fasteners. For example, the mechanical fastener may be a latch arm fastened at one end of the latch arm to the corresponding shelf and fastened at an opposite end of the latch arm to the rear edge of the planar portion. The planar portion may have a recess formed on the rear edge of the planar portion. The latch arm may be fastened to the rear edge, in the recess. The latch arm may be adapted to be horizontally pivotable about the ends of the latch arm relative to the rear edge and the corresponding shelf when the latch arm is being mounted to the rear edge and the corresponding shelf.

BRIEF DESCRIPTION OF THE DRAWINGS

FIG. 7 is a progression of diagrammatic views illustrating a re-stocking and facing method wherein FIG. 7*a* illustrates a workman standing in front of a set of pull out shelves having inventory requiring facing, FIG. 7*b* illustrates the workman pulling the shelf requiring facing outwardly toward the workman, FIG. 7*c* illustrates the workman moving the inventory to the front of the shelf so as to face the inventory, FIG. 7*d* illustrates the workman bending to pick up new inventory, FIG. 7*e* illustrates the workman placing the new inventory behind the now faced inventory, FIG. 7*f* illustrates the workman pushing the shelf back into its stored position under the other shelves, and FIG. 7*g* illustrates the workman standing up having now completed the facing and restocking job.

DETAILED DESCRIPTION OF EMBODIMENTS OF THE INVENTION

Figure 1:
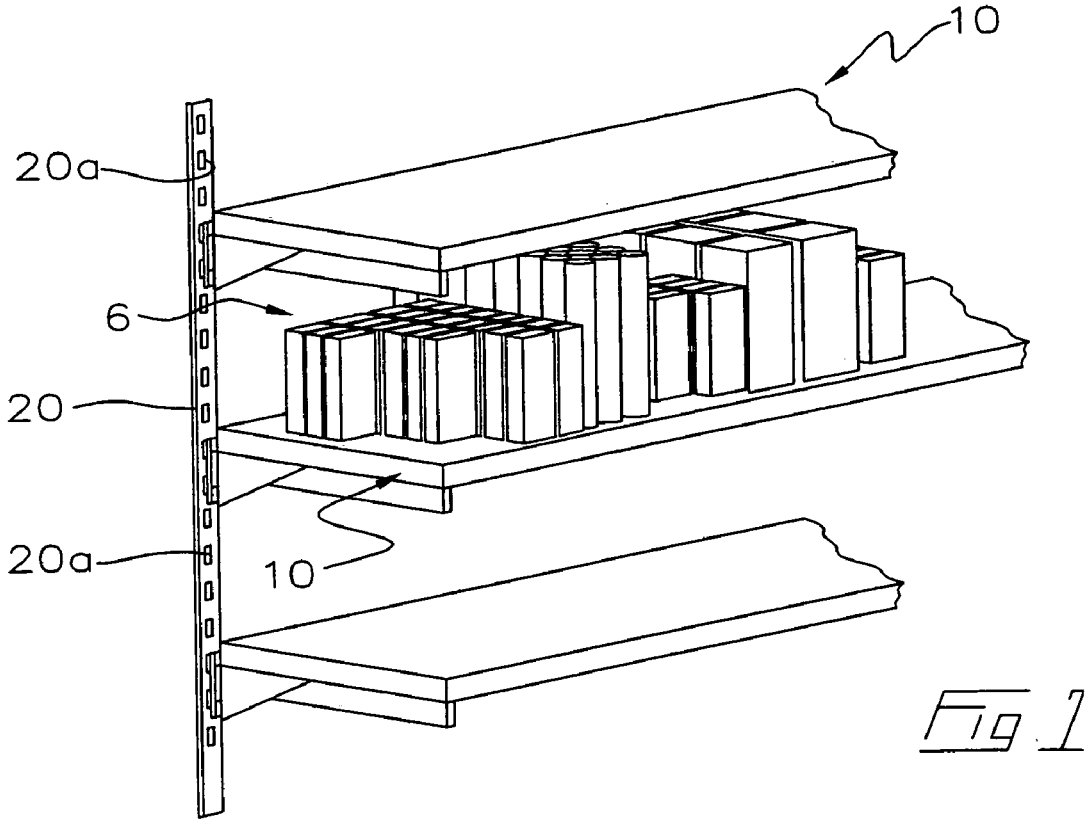
FIG. 1 is, in perspective view, a vertically spaced array of pull-out shelves according to one embodiment of the present invention mounted to a shelving standard.

As illustrated in FIGS. 1–5, the shelving system of the present invention streamlines the re-stocking process into five steps which follow onto how the stock on a shelf is typically left by consumers taking product from the shelf as seen in FIG. 1:

Step 1) Move new product to the vicinity of pull-out stock shelf 10 ready to be stocked onto shelf 10.

Figure 2:
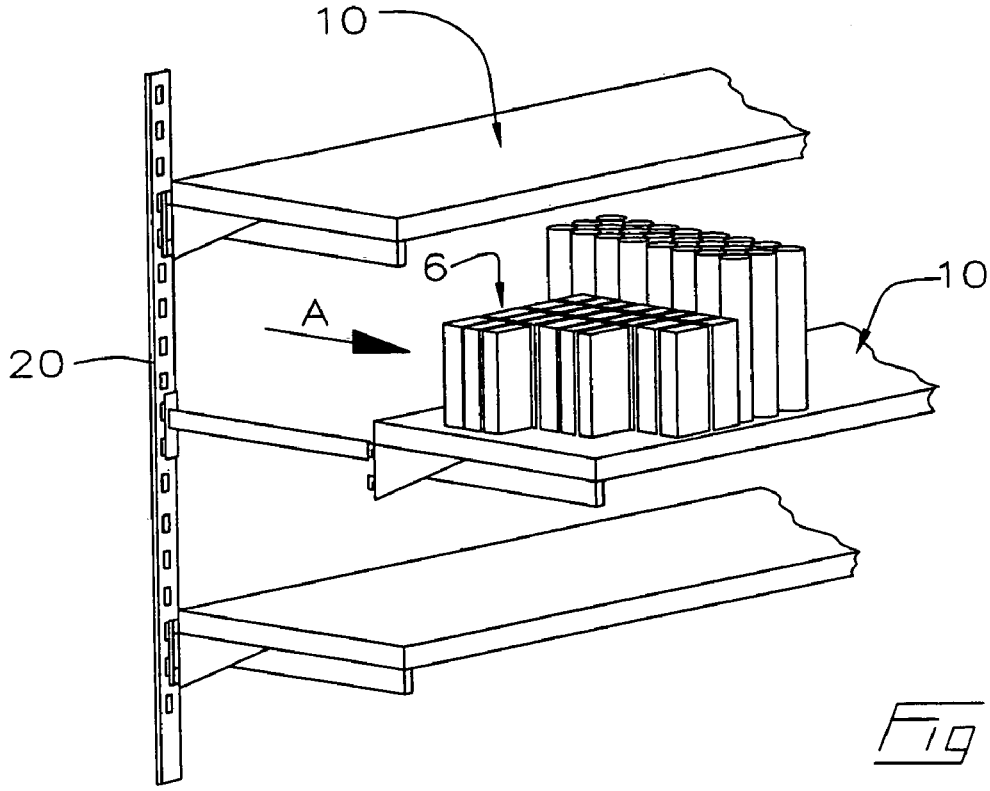
FIG. 2 is the view of FIG. 1 with one shelf slid outwardly from the standard.

Step 2) Pull shelf 10 forward in direction A as seen in FIG. 2 so as to cantilever shelf 10 from its support rack or standard 4 thereby allowing easy access to the old product 6 on shelf 10.

Figure 3:
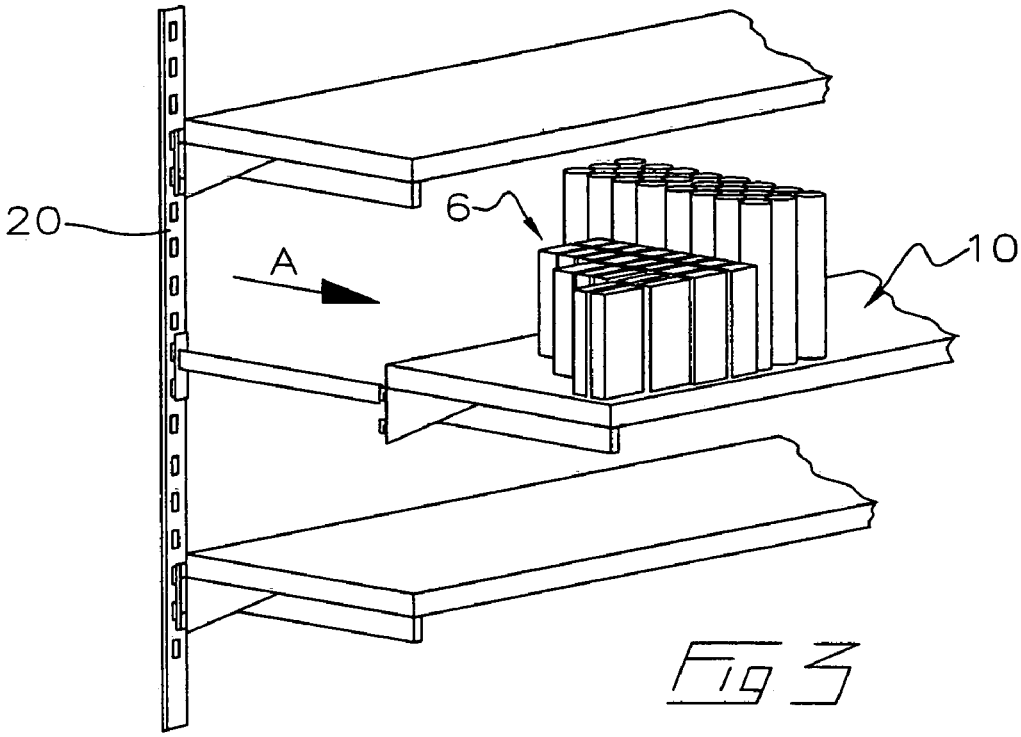
FIG. 3 is the view of FIG. 2 with existing product on the pulled out shelf moved forward and faced on the shelf.

Step 3) Move old product 6 forward on the shelf as seen in FIG. 3, thereby facing the shelf at the same time.

Figure 4:
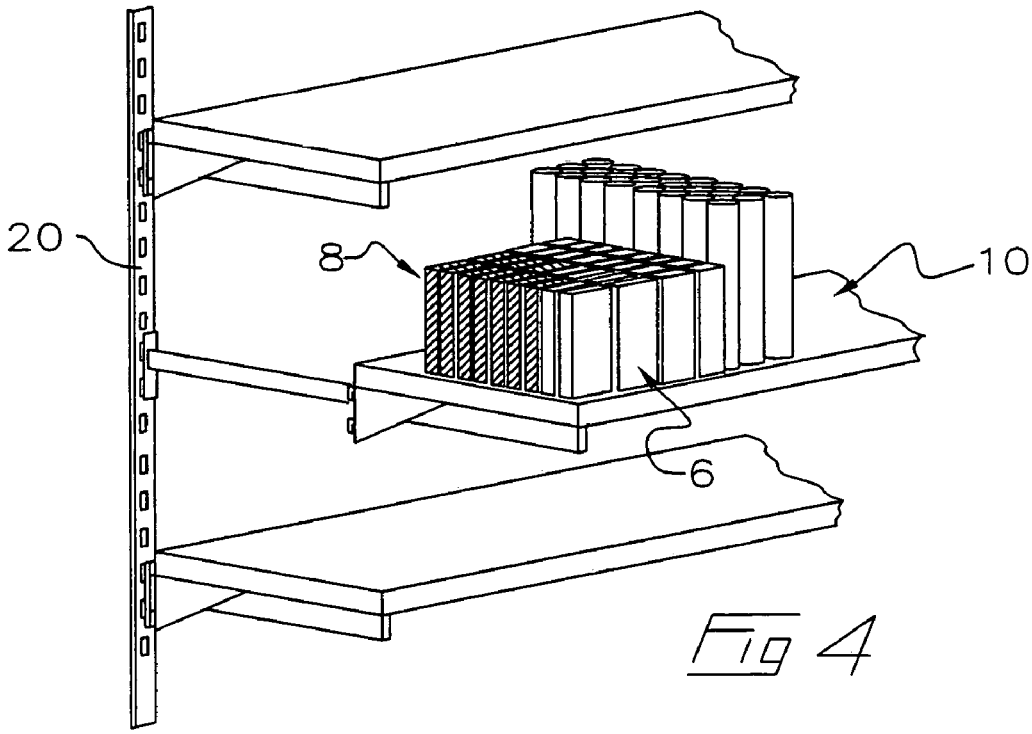
FIG. 4 is the view of FIG. 3 with new product stocked behind the previously faced product on the shelf in its extended position.

Step 4) Place new product 8 behind old product 6 as seen in FIG. 4.

Figure 5:
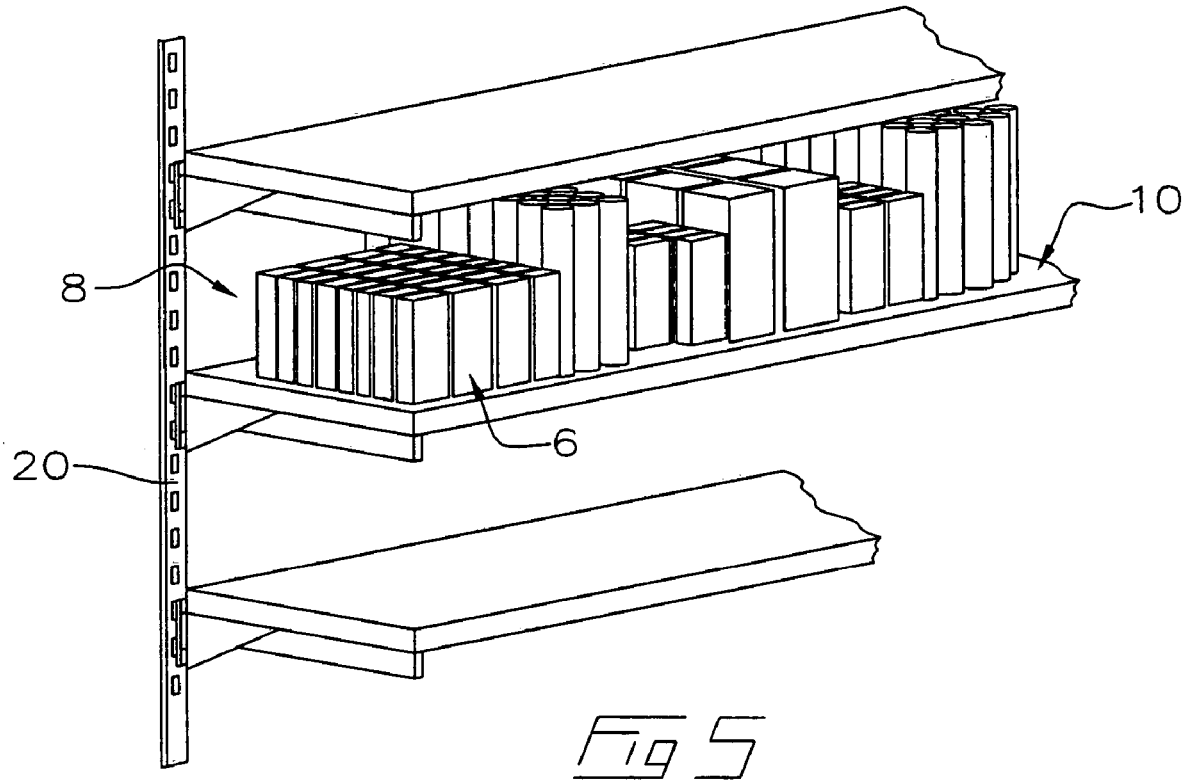
FIG. 5 is the view of FIG. 4 with the shelf returned to its retracted position against the shelf standard.

Step 5) Push shelf 10 back into place flush with other shelves as seen in FIG. 5.

Figures 6, 6A, 6B, 6C, 6D, 6E, 6F, 6G, 6H:
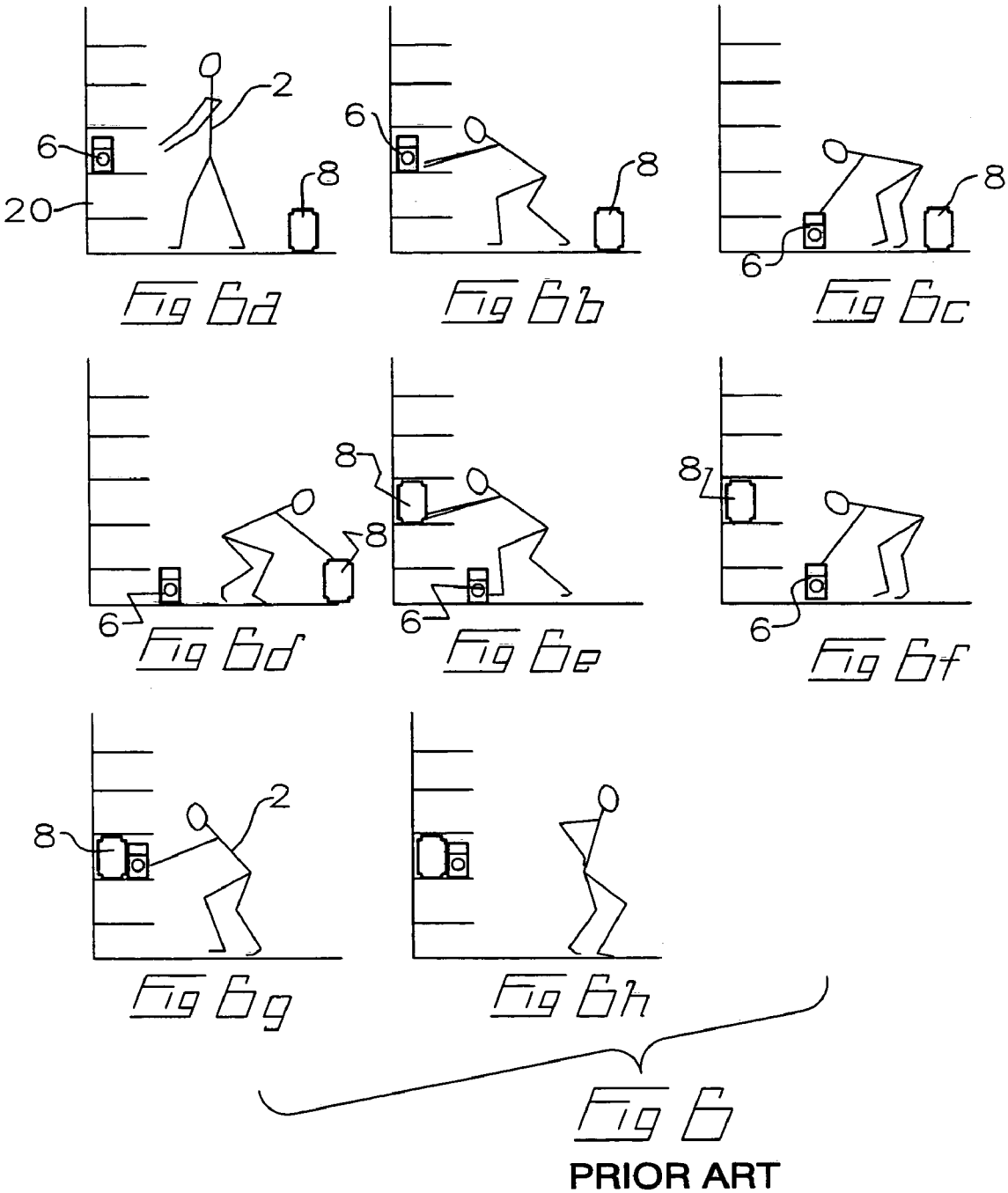
Fig 6 PRIOR ART
FIGS. 6*a*–6*h* are a progression of diagrammatic views illustrating a conventional method of re-stocking and facing product on a shelf mounted to a shelf standard.

A comparison of a conventional re-stocking method and posture with the stock shelving system and posture of the present invention is illustrated diagrammatically in FIGS. 6*a* to 6*h* and 7*a* to 7*g* respectively. The object is to have old stock faced with a minimum of bending-over by the re-stocking employees. Of note is that in the conventional re-stocking of conventional shelves in FIG. 6 the re-stocking person 2 spends most of the time bent over, while in the re-stocking according to the present invention as seen in FIG. 7 the re-stocking person spends most of the time standing rather than bent over. The advantage is a reduction of back fatigue.

Figure 8:
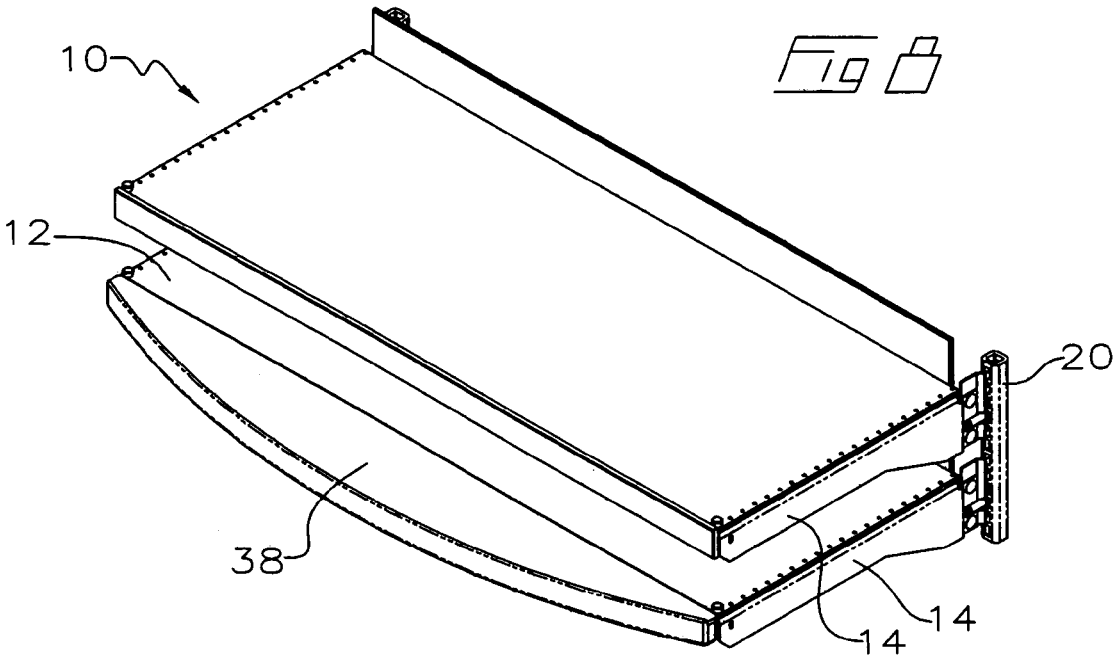
FIG. 8 is, in perspective view, a vertically spaced array of pull-out shelves according to one embodiment of the present invention, mounted to a laterally spaced apart parallel pair of shelving standards.
Figure 9:
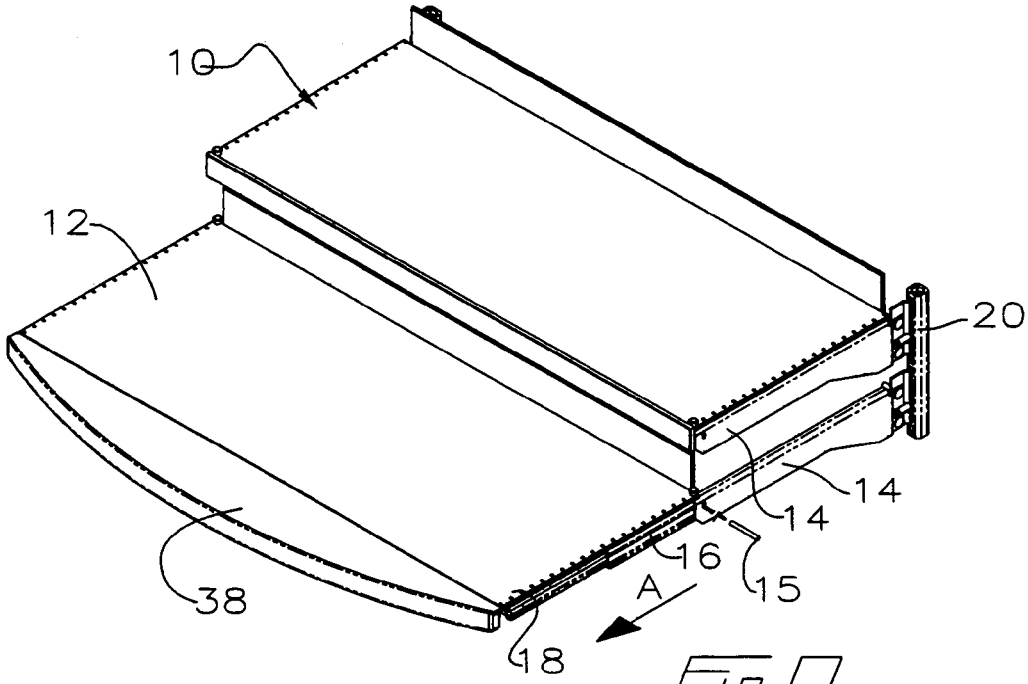
FIG. 9 is the view of FIG. 8 with the lower shelf slid forwardly outwardly into its extended position from the pair of standards.
Figure 10:
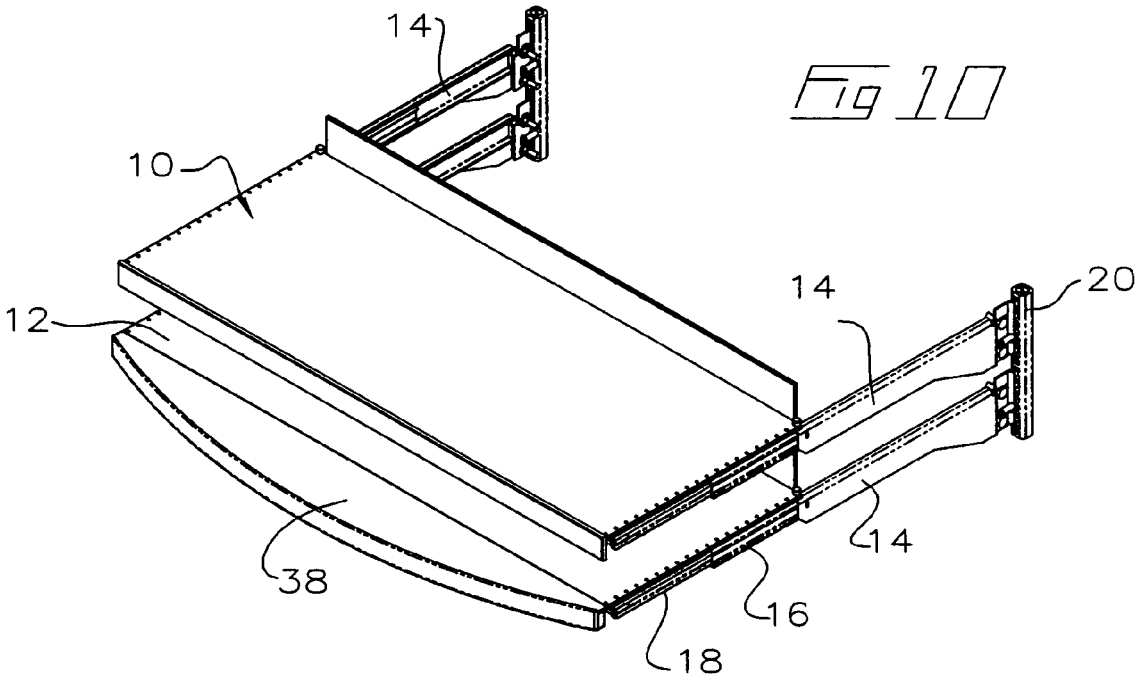
FIG. 10 is the view of FIG. 9 with both shelves slid outwardly from the pair of standards.

With reference to the drawings wherein similar characters of reference denote corresponding parts in each view, and as illustrated in FIGS. 8–10, the shelving system of the present invention includes one or more translatable shelves which may be retro-fitted for mounting to a laterally spaced apart pair of generally parallel standards. FIGS. 8–10 show the operation of two such shelves. In FIG. 8, both upper shelf 10 and lower shelf 12 are flush and in an un-extended, that is, retracted position. In FIG. 9, lower shelf 12 is extended forwardly in direction A, and in FIG. 10 both upper shelf 10 and lower shelf 12 are extended outwardly in direction A. The shelves slide in and out between the pair of mounting brackets 14 supporting the shelf Brackets 14 are cantilevered from the pair of standards. The sliding in and out of the shelves facilitates re-stocking of shelves 10 and 12 as old product on shelves 10 and 12 may be moved frontwards and new product placed rearwards on the shelves without necessitating the prior removal of old product from the shelves.

Figure 11:
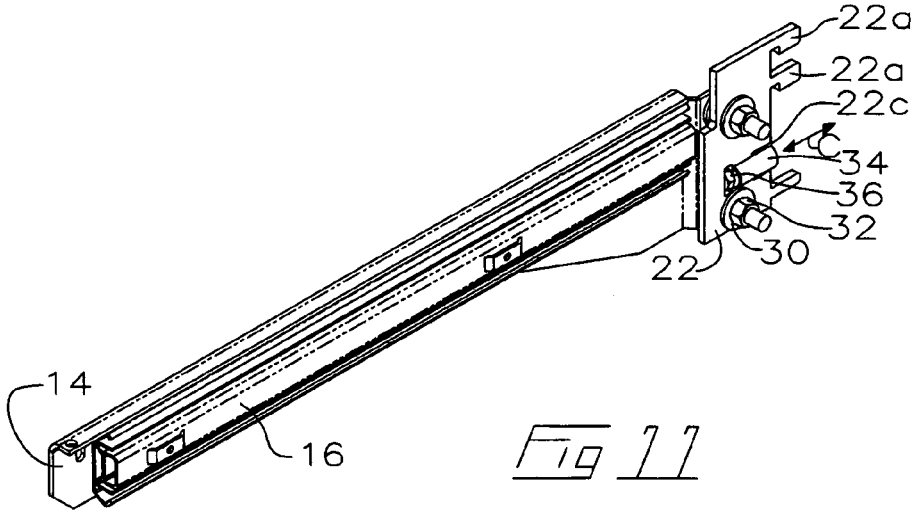
FIG. 11 is, in perspective view, a mounting bracket, drawer slide, and flat key of the shelving system according to the present invention.
Figure 13:
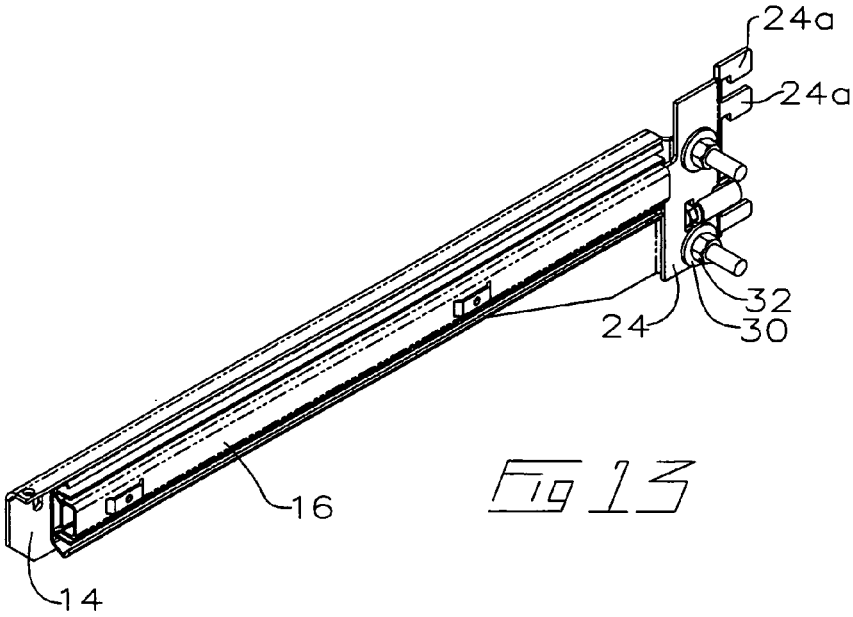
FIG. 13 is, in perspective view, the mounting bracket and drawer slide of FIG. 11 including a stepped key.
Figure 14:
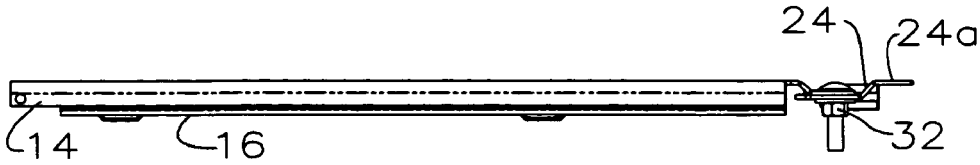
FIG. 14 is, in plan view, the stepped key assembly of FIG. 13.

Each shelf 10 lies flat between a corresponding pair of mounting brackets 14. Mounting brackets 14 are mounted to a corresponding pair of drawer slides 16 for mounting under the oppositely disposed pair of laterally extending ridges 18 extending from shelves 10. Brackets 14 themselves mount to conventional shelving standards 20 by the use of either flat or stepped keys 22 and 24 respectively, as seen in FIGS. 11 and 13, respectively. Keys 22 and 24 mate with apertures or slots in and along the outermost surface of standards 20. The use of either flat keys 22 or stepped keys 24, the latter for mounting around the base end of a bracket 14 as seen in FIG.

Figure 12:
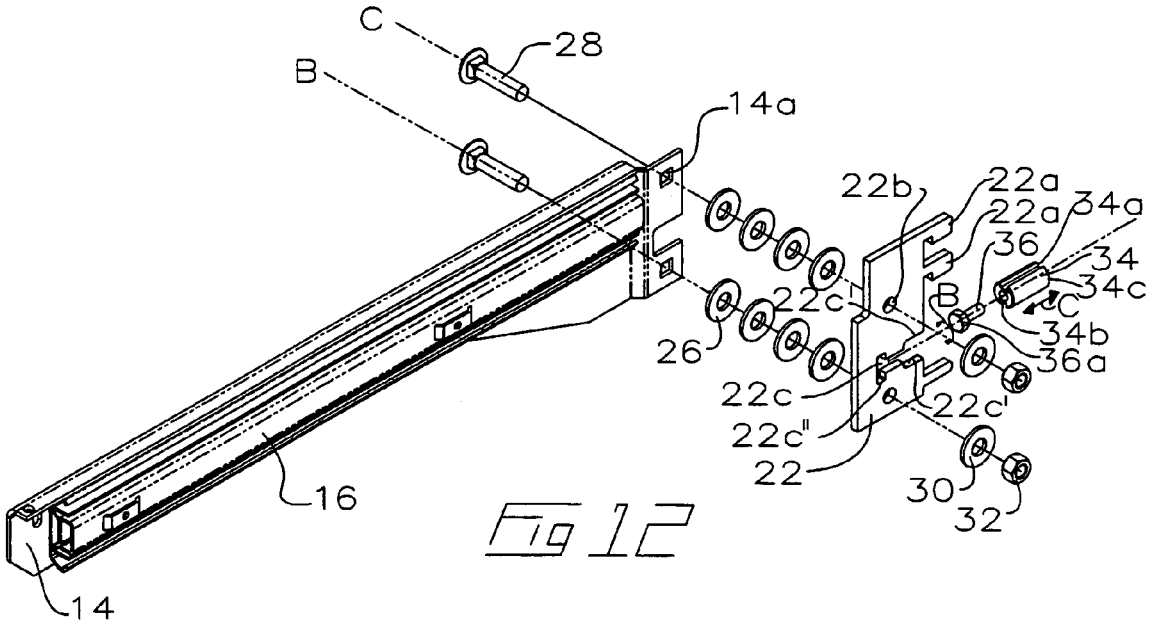
FIG. 12 is an exploded perspective view of FIG. 11.

14, or a combination of flat and stepped keys 22 and 24, combined with one or more spacers 26 sandwiched therebetween as better seen in FIG. 12, allow for the selective adjustment of the lateral width, for example along bolting axes B and C, to adjust the lateral spacing between keys, whether flat or stepped, on opposite lateral ends of each shelf 10. The spacers may be round washers as illustrated, but this is not intended to be limiting as other forms of rigid spacers would also work.

The use of stepped or flat keys, and spacers between the keys and brackets, allows for a retro-fit mating of shelves 10 onto pre-existing shelving standards 20 where the standard uprights have apertures or slots into which the key tangs or hooks 22*a* and 24*a* mate. Thus, for example, if shelf 10 is designed for retro-fit mounting into shelving standards having shelf widths varying between 47 ⅜ inches and 48 inches, and where spacers 26 and keys 22 and 24 are all one sixteenth of an inch thick, then, in one sixteenth inch increments, the positioning of keys 22 or 24 may be altered so as to correspond with slots in standards 20. Spacers 26 are mounted by means of bolts 42 which are journalled sequentially through apertures such as apertures 14*a* in each mounting bracket 14, one or more spacers 26, an aperture such as aperture 22*b* in keys 22 or 24, and washer 30 before threadably engaging nut 32. Stepped keys 24 also provide for mounting the brackets flush with the slots in the standards.

As seen in FIG. 12, keys 22 and 24 contain a cut-out, cavity or recess 22*c*. Threaded cylinder 34 and bolt 36 are mounted into cut-out 22*c*. Bolt 36 is threadably journalled into cylinder 34. Cylinder 34 has an upper channel 34*a* and a lower channel 34*b*. Edges 22*c*' along cut-out 22*c* slide into and along channels 34*a* and 34*b* to retain cylinder 34 non-rotatably mounted in cut-out 22*c*. The head 36*a* of bolt 36 rotatably mounts into slot 22*c*". When inserted as a unit into cavity 22*c*, as better seen in FIGS. 11 and 13, bolt 36 may be rotated in direction B to translate cylinder 34 in direction C translating cylinder 34 from cavity 22*c* and thereby bringing end 34*c* into forceful contact with the standard. This provides added stability to the shelves mounted on the standards.

Figure 15:
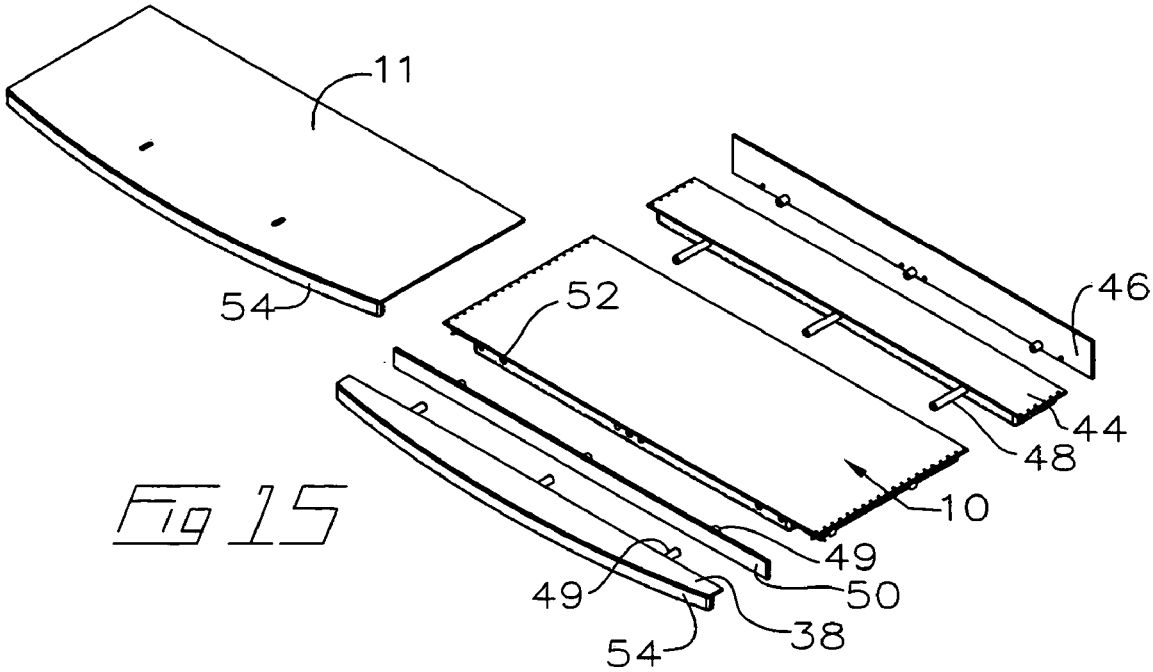
FIG. 15 is, in exploded perspective view, a modular pull-out shelf according to the present invention.

As seen in FIGS. 8–10 and FIG. 15, shelves 10 may have at their front edge a curved front extension member 38 to provide, among other advantages, greater shelf surface area for stocking products. In one embodiment, not intended to be limiting, extension member 38 may be modular as seen in FIG. 15 such that the depth of shelf 10 assembled according to the present invention may be increased by the insertion of rear extender shelf members 44 mounted to and coplanar with shelf 10 and front extension member 38. As seen in the exploded view of FIG. 15, the depth of the pull-out shelf 10 assembled according to the present invention may be selected by the depth of the rear extender shelf members 44 mounted to shelf 10. In a manner similar to the use of rear extender members 44, front extender members (not shown) may be mounted to the front of shelf 10 between shelf 10 and curved front extension member 38. Whether or not extender members are employed, a shelf 10 may be releasably locked in its extended or partially extended position by inserting for example pin 15 into a hole through the brackets and into a corresponding hole in an array of holes along the slides.

If curved front extender member 38 is neither required nor desired for a curved aesthetically pleasing finish, a planar front cover plate 50 may be employed instead of the use of curved front extender member 38. Alternatively, if no front extension member is required or desired but a curved front end is desired, shelf 10 may itself be convexly curved at its front end so as to resemble shelf 11 seen in FIG. 15.

The various extension members and, if present, front cover plate 50, are connected to each other and to shelf 10 in a modular fashion. A laterally spaced apart array of parallel mounting bores or apertures 52 are formed longitudinally through the front and rear ends of shelf 10 for receiving in sliding mating engagement therein, for example as seen in FIG. 15, bayonet mounting members 48 on rear extender member 44 and bayonet mounting members 49 on front extender member 38 or cover plate 50. Similarly, the various extension members employed, if any, and for example rear extension member 44, also contain corresponding bores 52 and bayonet mounting members 48 or 49 so as to engage adjacent extension members, shelf 10 or cover plate 50, as the case may be, in sliding mating engagement.

An upright backing member 46 may in some embodiments be mounted, again by the use of bayonet mounts 48 such as employed on the rear extender members so as to couple an upright rigid rearmost lip to the back of the assembled shelf assembled using one or a combination of the rear extender members, mounted to basic shelf 10.

In a further embodiment, again not intended to be limiting, eye-catching ornamentation such as small housings containing lit or flashing light emitting diodes or other means of attracting the attention of a consumer, may be mounted within member 38 or on the ends of any one of the front extension members. Further, member 38 may provide a housing for "smart-shelf" technology, such as RFID transponders, emitters or receivers communicating with RF tagged products, networked electronic price labels, networked to a central processor, for ease of price up-dates or time-of-day based adjustments, or for other marketing or merchandising technology. Collectively herein, and again without intending to be limiting, the above may be referred to as either electronic inventory management or electronic merchandising means.

Figure 16:
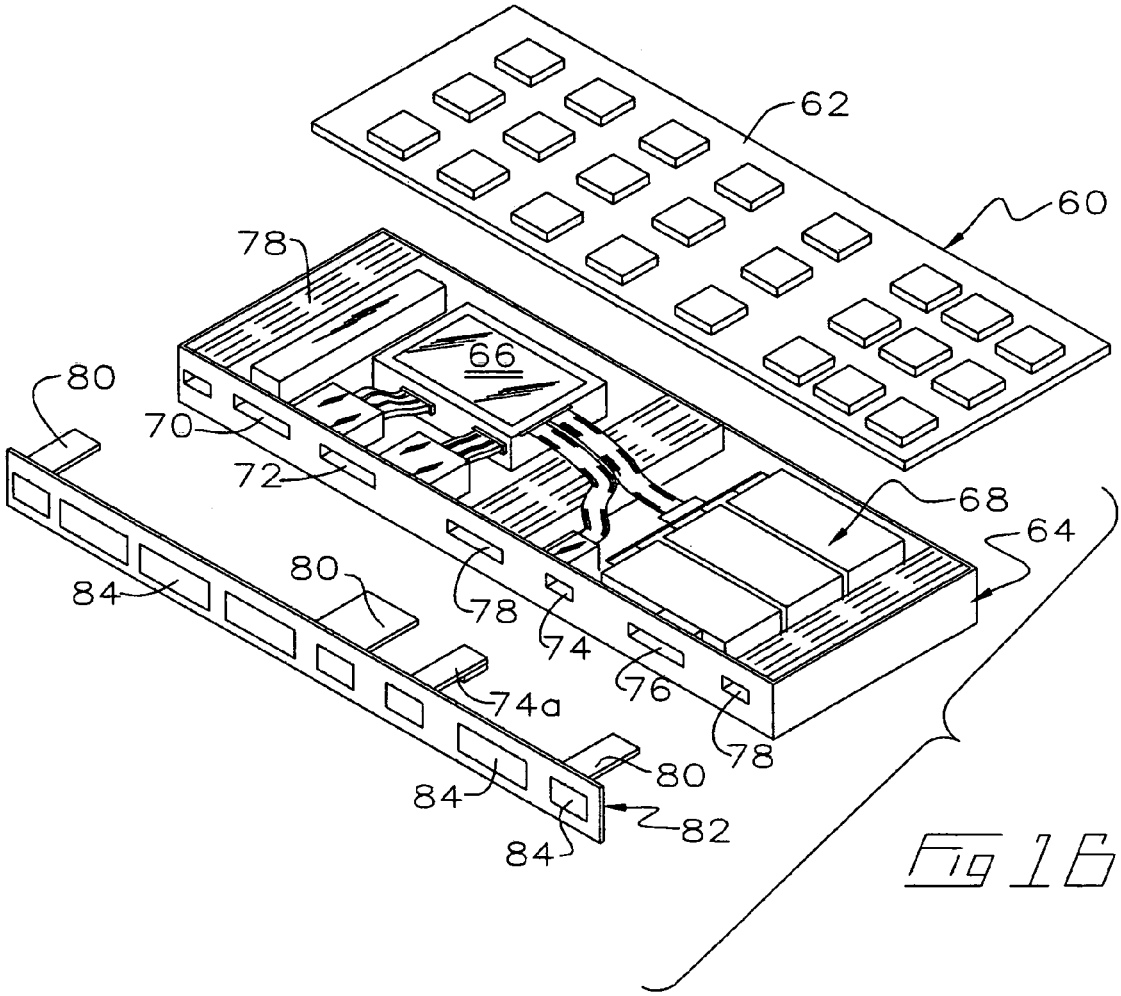
FIG. 16 is, in partially exploded perspective view, a smart-shelf module mountable into a shelf in the shelving system according to the present invention.
Figure 17:
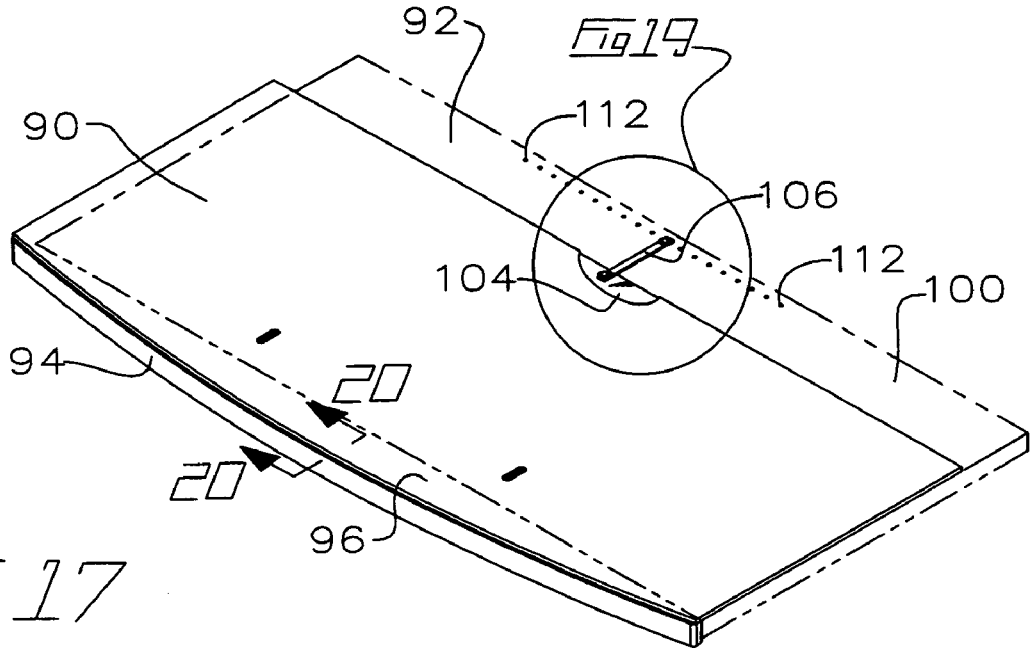
FIG. 17 is a perspective view of one form of shelf overlay according to the present invention.
Figure 18:
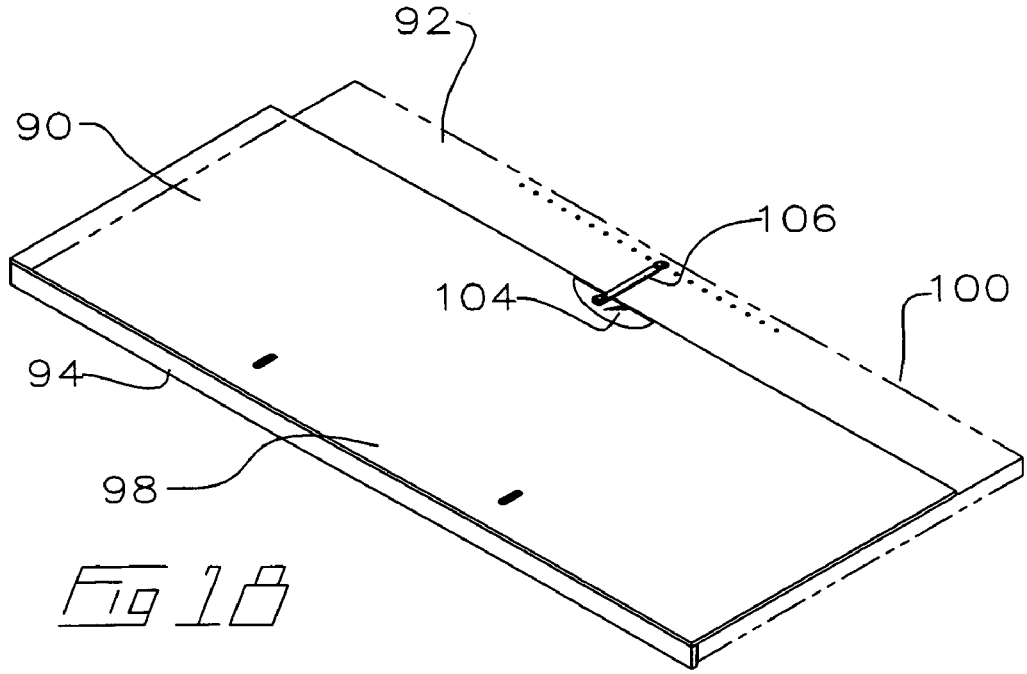
FIG. 18 is a perspective view of an alternative form of shelf overlay.
Figure 19:
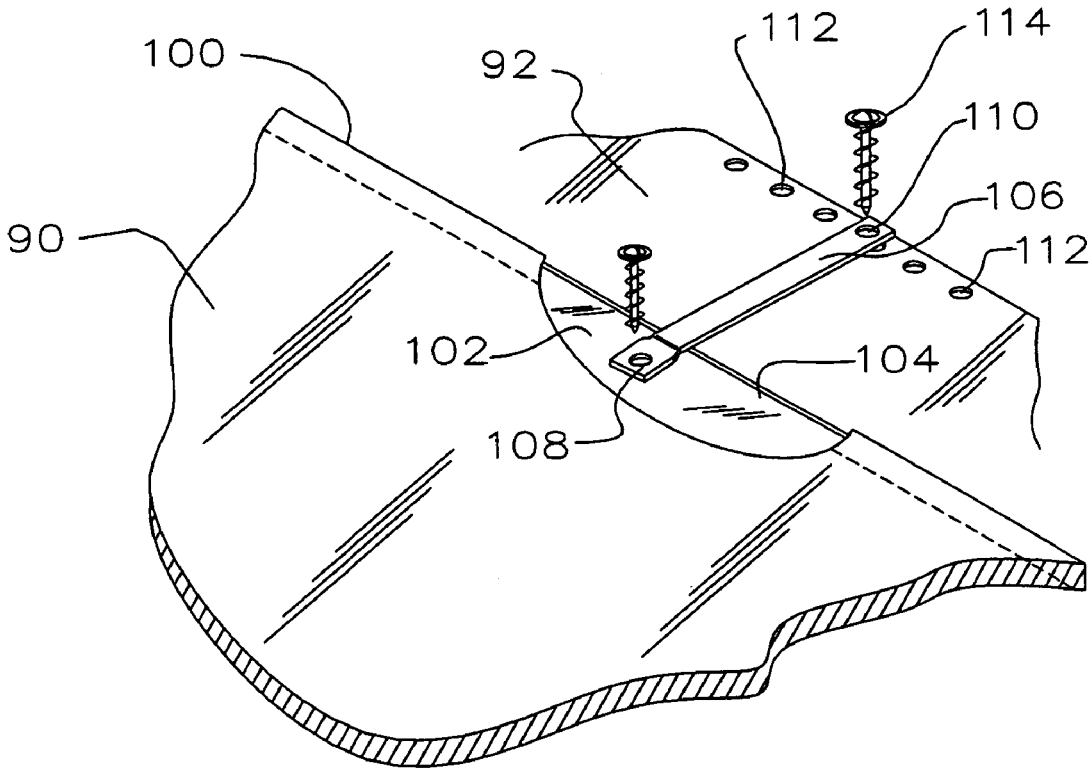
FIG. 19 is an enlarged portion of FIG. 18.

As seen in FIG. 16, smart shelf technology may include a modular unit 60 wherein a touch pad for inventory control 62 is mounted onto, so as to electronically cooperate with, a base frame 64 housing components such as processor 66, power supply 68 and various interface ports such as fibre optic ports 70, serial ports 72 and 74 (the latter for example being a so-called USB port), power port 76. Hollow docking members 78 may be mounted in parallel into frame 64 so as to receive docking members 80 slidably mated into their corresponding docking ports so as to thereby mount a front plate 82 onto the front of frame 64 for viewing from the front edge of a shelf into which unit 60 is modularly mounted. Docking members 80 align a male USB interface member 74*a* with corresponding USB serial port 74. Front plate 82 may contain mounted there along, electronic shelf labels 84, all of the above smart shelf technology not intending to be limited.

In a further embodiment as may be seen in FIGS. 17 through 20*a*, shelf overlay 90 may be readily adapted for mounting over an existing shelf 92. The longitudinal front edge 94 of shelf 90 may, as viewed in FIG. 17, may be formed as a curved front extender 96 or, as viewed in FIG. 18 be a planar front 98. The rear longitudinal edge 100 of shelf 92 may include a notch, cut-out, depression or recess 102. Mounting arm 106 has a mounting flange 108 formed at one of its ends. Flange 108 may be mounted, for example by the use of a fastener such as a screw, onto recess 102, through an aperture in the flange so that arm 106 may be rotated horizontally relative to the overlay. An aperture 110 near the opposite end of mounting arm 106 may then be selectively brought into alignment with, for example, one of several pre-formed holes 112 formed in shelf 92. Shelf 90 may then be firmly secured to existing shelf by screw 114 or other fasteners. In some instances, adhesives may be employed, either solely or in conjunction with the use of arm 106 or other mechanical clamps, fasteners etc., to secure the overlay onto the existing shelf.

Figure 20:
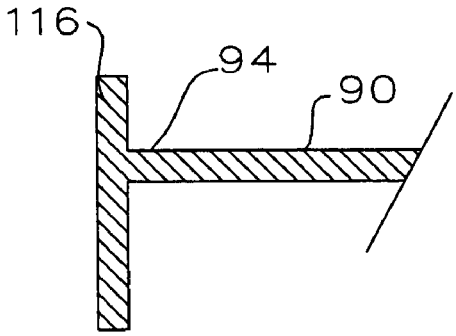
FIG. 20 is a sectional view taken on line 20—20 of FIG. 17.
Figure 20A:
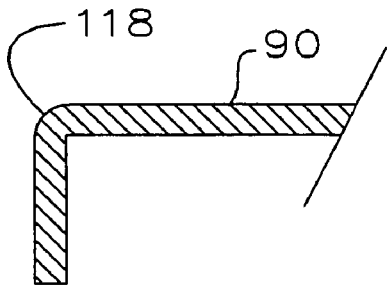
FIG. 20*a* is an alternative sectional profile to that illustrated in FIG. 20.

As may be seen in FIGS. 20 and 20*a,* the longitudinal front edge 94 of shelf 90 may be formed as an upstanding lip 116 or alternatively be smoothly rounded as at 118, without upstanding lip 116.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A shelving system having at least one horizontal shelf mounted, at opposite ends of the at least one shelf, to a pair of parallel and vertical spaced apart shelving standards, wherein the improvement comprises at least one shelf overlay mountable onto corresponding shelves of the at least one shelf, and wherein each shelf overlay of said at least one shelf overlay includes:

a rigid planar portion bounded by a front edge, an opposite rear edge, and opposite side edges, a lip, orthogonal to said planar portion, is mounted along said front edge so as to extend from each said opposite side edges, said lip extending downwardly from said planar portion so as to substantially cover a front edge surface of a corresponding shelf when said shelf overlay is mounted onto the corresponding shelf, said lip extending upwardly from said planar portion, mounting means for mounting said planar portion onto an upper surface of the corresponding shelf, wherein said lip is convexly curved in a horizontal plane.

2. The shelf overlay of claim 1 wherein said mounting means includes an adhesive.

3. The shelf overlay of claim 2 wherein aid mounting mans further includes a mechanical fastener.

4. The shelf overlay of claim 1 wherein said mounting means includes a mechanical fastener.

5. The shelf overlay of claim 4 wherein said mechanical fastener is a latch arm fastened at one end of said latch arm to the corresponding shelf and fastened at an opposite end of said latch arm to said rear edge of said planar portion.

6. The shelf overlay of claim 5 wherein a recess is formed in said planar portion on said rear edge and said latch arm is fastened to said rear edge in said recess.

7. The shelf overlay of claim 6 wherein said latch arm is adapted to be horizontally pivotable about said ends of said latch arm relative to said rear edge and the corresponding shelf when said latch arm is being mounted to said rear edge and the corresponding shelf.

8. A shelving system having at least one horizontal shelf mounted, at opposite ends of the at least one shelf, to a pair of parallel and vertical spaced apart shelving standards, wherein the improvement comprises at least one shelf overlay mountable onto corresponding shelves of the at least one shelf, and wherein each shelf overlay of said at least one shelf overlay includes:

a rigid planar portion bounded by a front edge, an opposite rear edge, and opposite side edges, a lip, orthogonal to said planar portion, is mounted along said front edge so as to extend from each said opposite side edges, said lip extending downwardly from said planar portion so as to substantially cover a front edge surface of a corresponding shelf when said shelf overlay is mounted onto the corresponding shelf, said lip extending upwardly from said planar portion, mounting means for mounting said planar portion onto an upper surface of the corresponding shelf, wherein said mounting means includes a mechanical fastener, and wherein said mechanical fastener is a latch arm fastened at one end of said latch arm to the corresponding shelf and fastened at an opposite end of said latch arm to said rear edge of said planar portion.

9. The shelf overlay of claim 8 wherein a recess is formed in said planar portion on said rear edge and said latch arm is fastened to said rear edge in said recess.

10. The shelf overlay of claim 9 wherein said latch arm is adapted to be horizontally pivotable about said ends of said latch arm relative to said rear edge and the corresponding shelf when said latch arm is being mounted to said rear edge and the corresponding shelf.

11. The shelf overlay of claim 10 wherein said lip is convexly curved in a horizontal plane.

* * * * *